US005830537A

United States Patent [19]

Telama

[11] Patent Number: 5,830,537

[45] Date of Patent: Nov. 3, 1998

[54] METHOD FOR MANUFACTURING A ROLL FOR USE IN THE PRODUCTION OF PAPER

[75] Inventor: Ari Telama, Jyväskylä , Finland

[73] Assignee: Valmet Corporation, Helsinki, Finland

[21] Appl. No.: 733,251

[22] Filed: Oct. 18, 1996

[30] Foreign Application Priority Data

Oct. 23, 1995 [FI] Finland ..... 955040

[51] Int. Cl.[6] ..... C23C 4/18

[52] U.S. Cl. ..... 427/454; 427/453; 427/343

[58] Field of Search ..... 427/453, 454, 427/343; 492/58, 59, 53

[56] References Cited

U.S. PATENT DOCUMENTS

| | | | |
|---|---|---|---|
| 3,944,683 | 3/1976 | Church et al. | 427/454 |
| 5,123,152 | 6/1992 | Tenkula et al. | 29/132 |
| 5,171,404 | 12/1992 | Ellis et al. | 162/206 |
| 5,257,966 | 11/1993 | Watanabe et al. | 492/376 |
| 5,411,462 | 5/1995 | Link | 492/30 |

FOREIGN PATENT DOCUMENTS 914721 4/1992 Finland .

*Primary Examiner*—Katherine A. Bareford
*Attorney, Agent, or Firm*—Steinberg & Raskin, P.C.

[57] ABSTRACT

A method for manufacturing a roll for use in the production of paper in which the roll is coated by thermal spraying. A sealing-agent solution is spread onto a coating of the roll which is produced by thermal spraying to seal pores in the coating, the sealing-agent solution is then allowed to be absorbed into the pores in the coating. The roll is heated in order to eliminate the water from the sealing-agent solution, and upon elimination of the water, the sealing-agent solution crystallizes in the pores in the coating after which the roll is allowed to cool. A roll for use in the production of paper having a frame and a roll coating produced by thermal spraying. The coating is sealed by crystals formed out of a sealing-agent solution after the elimination of water therefrom. A coating for a roll for use in the production of paper produced by thermal spraying and having pores. In order to seal the coating, a sealing agent is crystallized in the pores in the coating.

17 Claims, 1 Drawing Sheet

METHOD FOR MANUFACTURING A ROLL FOR USE IN THE PRODUCTION OF PAPER

FIELD OF THE INVENTION

The invention relates to a method for manufacturing a roll for use in the production of paper in which the roll is coated by means of thermal spraying. Further, the invention relates to a roll for use in the production of paper which comprises a frame and a roll coating produced by means of thermal spraying. The invention also relates to a coating for a roll for use in the production of paper which is produced by means of thermal spraying and includes pores.

BACKGROUND OF THE INVENTION

In the past, the only alternative for a center roll in a press section of a paper machine was a rock roll, which was usually made of granite. The popularity of granite was based on its surface properties which enable controlled separation of the paper web from the rock face and, moreover, granite tolerates the abrading effect of a doctor which is used in conjunction with a center roll very well. However, granite has certain drawbacks. Specifically, since it is a natural material, its properties show variation, and internal flaws in granite and its tendency of cracking form a series obstacle for its use in some applications. For this reason, today, as the center roll of the press section of a paper machine, a coated roll is used very frequently, in particular a roll coated with an oxide coating.

In the art of the production of paper, coated rolls are also used in a great variety of other applications, for example as press rolls, suction rolls, and as rolls of calenders and supercalenders.

The coating can be added in a number of different manufacturing processes onto the various rolls employed in the production of paper, and specifically onto a roll frame of the roll. One important process for adding the coating onto a roll is thermal spraying. However, in this type of coating process, the problem occurred that a certain degree of porosity has tended to remain in the roll coatings, i.e., the thermal spraying results in pores in the coating. This tendency occurs in particular in coatings prepared from oxide ceramic by thermal spraying, because oxide materials are poorly meltable. Oxide coatings are, however, highly suitable roll coatings for applications in which requirements are imposed concerning separation of the paper web, resistance to wear, resistance to corrosion, doctoring, and keeping clean. Such applications are, for example, the center roll in a press section of a paper machine and the rolls in calenders.

It has been one of the more prominent problems in thermally sprayed roll faces that the pores in the roll face are readily filled with contaminants existing and forming in connection with the manufacture of paper, for example pitch, or pastes contained in recycled pulps. When the pores in the roll coating are contaminated, the properties of the coating can be changed and, moreover, there is the risk that the contaminants/moisture break the boundary faces between the pores, in which case the coating is also worn by cracking and splitting.

It is one prior art application for sealing the pores in the coatings that so-called sealing agents are made to penetrate into the porous face. One prior art application of such a sealing agent consists of thermosetting plastics which are composed of two or more components and which have a low viscosity when not solidified. In roll faces sealed in this manner, problems have, however, arisen from the fact that the suitability for doctoring is deteriorated because the plastic face tends to become smooth. Moreover, the smoothing may cause problems of runnability, because the properties of separation of paper are also changed.

OBJECTS AND SUMMARY OF THE INVENTION

Accordingly, it is an object of the present invention to provide a new method for manufacturing a roll and a coated roll which eliminate or at least minimize the problems described above and arising from the porosity of the roll faces prepared by means of thermal spraying.

It is another object of the present invention to provide a new and improved method for manufacturing a roll for use in the production of paper in which the roll is coated by means of thermal spraying.

It is still another object of the present invention to provide a new and improved roll for use in the production of paper which comprises a roll frame and a roll coating produced by means of thermal spraying on the roll frame.

It is yet another object of the present invention to provide a new and improved coating for a roll for use in the production of paper which is produced by means of thermal spraying to thereby have an initially porous coating.

In view of achieving the objects stated above and others, in the method in accordance with the invention, a sealing-agent solution is spread onto the coating of the roll which has been produced by means of thermal spraying in order to seal the pores in the coating formed during the thermal spraying operation, the sealing-agent solution is allowed to be absorbed into the pores in the coating, the roll is heated in order to eliminate the water from the sealing-agent solution, whereby the sealing-agent solution crystallizes in the pores in the coating on elimination of the water, and the roll is then allowed to cool.

In the roll in accordance with the invention, the outer surface of the roll is coated with a coating which has been sealed by means of crystals formed out of a sealing-agent solution on elimination of water (the dehydration of the sealing-agent solution).

Further, in the roll coating in accordance with the invention a sealing agent is crystallized in the pores in the coating in order to seal the coating.

According to the invention, the porous roll coating is sealed by means of a ceramic sealing agent, in particular by means of a phosphate sealing agent. Further, the ceramic sealing, in particular phosphate sealing, can be carried out, for example, so that onto the coated roll $Al(OH)_3$—$H_3PO_4$ solution is spread. The solution is allowed to be absorbed into the pores in the coating during a certain period of time, for example twelve hours, after which the temperature of the roll is raised slowly and successively to a final temperature in a range from about 200° C. to about 400° C. during which heating, water is eliminated from the solution (i.e., the solution is dehydrated). Owing to the elimination of water, the solution crystallizes in the pores in the coating as phosphate compounds of aluminum, for example $AlPO_3$, $AlPO_4$, etc.

It is a second, alternative mode of penetration of the phosphate sealing agent into the porous coating that, instead of the $Al(OH)_3$—$H_3PO_4$ solution mentioned above, a mixture of phosphoric acid, for example 85% orthophosphoric acid $H_3PO_4$ and finely divided ceramic powder or powders of a particle size, for example, smaller than about 3 $\mu$m, is used. Materials suitable for this purpose are, for example, $Al_2O_3$ and $Cr_2O_3$. The ceramic powder is dissolved into the phosphoric acid, whereby a solution is formed, which is made to penetrate into the porous face of the roll by absorbing during a period of time long enough, after which water is eliminated during heating, whereby aluminum phosphate and/or chromium phosphate is/are formed. It should be understood that other suitable compounds could also be used in accordance with the invention without deviating from the scope and spirit thereof.

After the treatment of the coating mentioned above, any extra phosphate that may remain on the roll face is wiped away, for example, with silicon carbide paper. This step may be performed after the roll has completely cooled.

The good and beneficial properties of the phosphate sealing are based on the fact that the sealing agent blocks the pores and, moreover, the phosphoric acid that is included reacts with the oxide material in the coating and "glues" this material together. As a result of this gluing or adherence, the wear of the coating by means of cracking and splitting is also excluded and decreases.

After conducting experiments in order to ascertain specific advantages of the sealing described above, the following advantages were established:

Sealing of the roll coating with aluminum oxide increases the microhardness of the coating by about 250 HV03 units (Vickers hardness measurement with a weight of 0.3 kilogram), and sealing with chromium oxide by about 300 HV03 units, and with zirconium oxide by about 300 HV03 units. The increased microhardness and the ("gluing") effect of phosphoric acid increase the wear resistance of the coating. In an abrasive wear test, the wear resistances of the coatings were improved with aluminum oxide even to ten-fold, with chromium oxide to five-fold, and with zirconium oxide to eight-fold. Moreover, in electrochemical corrosion tests, it was noticed that the capacity of corrosion protection of the coating was improved by up to five decades. Moreover, the sealing increases the resistance of the coating to delamination as well as the property of remaining clean (maintaining its relative cleanliness) because contaminants cannot penetrate into the pores in the coating.

Besides the exemplifying embodiments described above, for sealing it is also possible to use, for example, a mixture of phosphoric acid and very finely divided oxide ceramic, the finely divided oxide ceramic being partly dissolved in the phosphoric acid, and the sealing of the roll coating is carried out by means of the methods described above.

BRIEF DESCRIPTION OF THE DRAWINGS

In the following, the invention will be described in more detail with reference to the figures in the accompanying drawing, wherein.

DETAILED DESCRIPTION OF THE PREFERRED EMBODIMENTS

Figure 1:
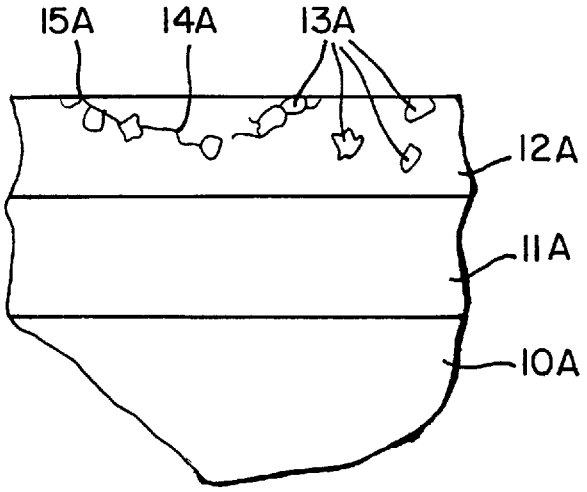
FIG. 1 PRIOR ART
FIG. 1 is a schematic sectional view in part of a prior art roll provided with a roll coating.

Referring to the accompanying drawings, FIG. 1 shows a prior art roll in which a roll frame 10A is provided with an adhesion layer 11A onto which a ceramic layer 12A is applied. The face of the ceramic layer 12A includes pores 13A and cavities 14A between the pores 13A. In such a case, it is entirely possible that the roll coating splits along a crack 15A that is formed during operation of the roll. The crack 15A proceeds to develop through the pores 13A and cavities 14A.

Figure 2:
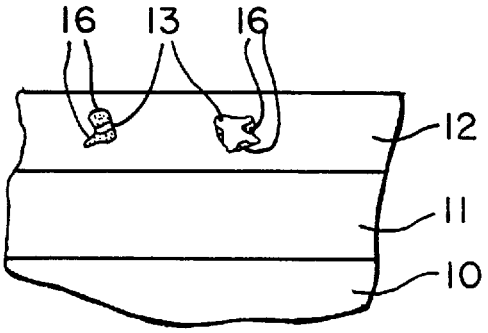
FIG. 2 is a schematic sectional view in part of a roll coated and sealed in accordance with the present invention.

FIG. 2 is a schematic sectional view in part of a sealed roll coating in accordance with the invention in which a roll frame is denoted by reference numeral 10, an adhesion layer overlying the roll frame 10, which adhesion layer is present in this embodiment but is not required, is denoted by reference numeral 11, and a coating layer overlying the adhesion layer 11 is denoted by reference numeral 12. The coating 12 has pores 13, i.e., it is a porous coating, which are sealed with a sealing agent 16 and in view of this sealing, contaminants cannot penetrate into the pores 13 and a crack cannot proceed along cavities between the pores 13.

In the method in accordance with the present invention, the roll coating 12 which has been applied onto the roll frame by means of thermal spraying, either onto an adhesion layer 11 or directly onto the roll frame 10, is sealed so that a ceramic sealing agent in the form of an acid solution penetrates into the roll coating. The solution of sealing agent is absorbed into the pores in the coating during a certain period of time, for example twelve hours, during formation or fabrication of the roll. After this absorption, the temperature of the roll is raised slowly and successively to a final temperature of about 200° C. to about 400° C. Owing to this heating, water is eliminated out of the solution so that the solution crystallizes in the pores in the coating as compounds of the ceramic, and the accompanying acid glues the ceramic material together. The sealing agent is a solution or alternatively in liquid form which implies that it is capable of releasing some amount of water upon heating. After this crystallization, the roll is allowed to cool, whereupon any extra material is wiped away from the roll face by means of any suitable cleansing method.

The roll coating 12 may be an oxide coating, for example $Y_2O_3$, $Al_2O_3$, $Cr_2O_3$, $ZrO_2$, $SiO_2$, MgO, $TiO_2$, $CeO_2$, or any other roll coating prepared by thermal spraying, for example a mixture of oxide and carbide or oxide and nitride.

As the ceramic sealing agent, preferably phosphate sealing agents are used, but also fluorophosphoric acid ($H_2PO_3F$) and chromic acid are suitable for sealing agents.

According to a preferred exemplifying embodiment of the invention, the thermally sprayed roll coating is sealed by means of a phosphate sealing agent, in which connection $Al(OH)_3$—$H_3PO_4$ solution is spread onto the coated roll. The solution is allowed, i.e., given the right atmosphere and conditions such as time, to be absorbed into the pores in the coating, e.g., for about twelve hours, and after this absorption, the temperature of the roll is raised slowly and successively to a final temperature of from about 200° C. to about 400° C., during which process water is eliminated from the solution. As a result of the elimination of water, the solution crystallizes in the pores in the coating as phosphate compounds of aluminum (e.g., $AlPO_3$, $AlPO_4$, etc.).

According to a second preferred exemplifying embodiment of the invention, instead of the $Al(OH)_3$—$H_3PO_4$ solution, a mixture of phosphoric acid, for example 85% orthophosphoric acid $H_3PO_4$ and finely divided ceramic powder or powders of a particle size, for example, smaller than 3 $\mu$m, is used. Materials suitable for this purpose are, for example, $Al_2O_3$ and $Cr_2O_3$. Out of the phosphoric acid and the ceramic powder/powders, a solution is formed which is absorbed into the pores in the coating. When the roll is heated slowly and successively to a temperature of from about 220° C. to about 280° C., water is eliminated from the solution. As a result of the elimination of water from the solution, the solution crystallizes in the pores in the coating as phosphate compounds of aluminum and/or chromium.

The examples provided above are not meant to be exclusive. Many other variations of the present invention would be obvious to those skilled in the art, and are contemplated to be within the scope of the appended claims. For example, it should be understood that the method disclosed herein can be used for any type of roll for use in paper production, not only a center roll for a press section, and similarly that the coating and roll can be used as any paper production roll, or even possibly other types of rolls in similar or different applications.

I claim:

1. A method for manufacturing a roll for use in the production of paper by thermally spraying a coating onto the roll whereby pores are formed in the coating, comprising the steps of:

spreading a phosphate sealing-agent solution onto the coating of the roll, the phosphate sealing-agent solution including $Al(OH)_3$—$H_3PO_4$, allowing the phosphate sealing-agent solution to be absorbed into the pores in the coating, sealing the pores in the coating by heating the roll with the phosphate sealing-agent solution absorbed into the pores to a temperature of from about 200° C. to a maximum of about 400° C. such that water in the phosphate sealing-agent solution is removed and the phosphate sealing-agent solution crystallizes in the pores in the coating to thereby provide the coating with a non-porous outer surface, and cooling the roll prior to use.

2. The method of claim 1, further comprising the step of wiping away excess crystallized sealing-agent solution after the roll is cooled.

3. The method of claim 1, further comprising the step of applying an adhesion layer onto the roll prior to the thermal spraying of the coating onto the roll such that the coating is thermally sprayed onto the adhesion layer.

4. The method of claim 1, wherein the coating is an oxide ceramic material whereby the sealing-agent solution is reactive with the oxide ceramic material.

5. The method of claim 1, wherein the step of allowing the sealing-agent solution to be absorbed into the pores in the coating comprises the step of maintaining the sealing-agent solution on the coating for about 12 hours.

6. A method for manufacturing a roll for use in the production of paper by thermally spraying a coating onto the roll whereby pores are formed in the coating, consisting essentially of the steps of:

spreading a phosphate sealing-agent solution onto the coating of the roll, the phosphate sealing-agent solution comprising a mixture of 85% orthophosphoric acid and at least one ceramic powder selected from a group consisting of $Al_2O_3$ and $Cr_2O_3$, allowing the phosphate sealing-agent solution to be absorbed into the pores in the coating, sealing the pores in the coating by heating the roll with the phosphate sealing-agent solution absorbed into the pores such that water in the phosphate sealing-agent solution is removed and the sealing-agent solution crystallizes in the pores in the coating, and cooling the roll prior to use.

7. The method of claim 6, further comprising the step of wiping away excess crystallized sealing-agent solution after the roll is cooled.

8. The method of claim 6, wherein the roll is heated to a temperature of from about 200° C. to a maximum of about 400° C. during the heating step.

9. The method of claim 6, further comprising the step of applying an adhesion layer onto the roll prior to the thermal spraying of the coating onto the roll such that the coating is thermally sprayed onto the adhesion layer.

10. The method of claim 6, wherein the coating is an oxide ceramic material whereby the phosphate sealing-agent solution is reactive with the oxide ceramic material.

11. The method of claim 6, wherein the step of allowing the sealing-agent solution to be absorbed into the pores in the coating comprises the step of maintaining the sealing-agent solution on the coating for about 12 hours.

12. A method for manufacturing a roll for use in the production of paper by thermally spraying a coating onto the roll whereby pores are formed in the coating, comprising the steps of:

spreading a sealing-agent solution containing flourophosphoric acid ($H_2PO_3F$) onto the coating of the roll, allowing the sealing-agent solution to be absorbed into the pores in the coating, sealing the pores in the coating by heating the roll with the sealing-agent solution absorbed into the pores such that water in the sealing-agent solution is removed and the sealing-agent solution crystallizes in the pores in the coating to thereby provide the coating with a non-porous outer surface, and cooling the roll prior to use.

13. The method of claim 12, further comprising the step of wiping away excess crystallized sealing-agent solution after the roll is cooled.

14. The method of claim 12, wherein the roll is heated to a temperature of from about 200° C. to a maximum of about 400° C. during the heating step.

15. The method of claim 12, further comprising the step of applying an adhesion layer onto the roll prior to the thermal spraying of the coating onto the roll such that the coating is thermally sprayed onto the adhesion layer.

16. The method of claim 12, wherein the coating is an oxide ceramic material whereby the sealing-agent solution is reactive with the oxide ceramic material.

17. The method of claim 12, wherein the step of allowing the sealing-agent solution to be absorbed into the pores in the coating comprises the step of maintaining the sealing-agent solution on the coating for about 12 hours.

* * * * *